US006565798B2

(12) United States Patent
Gurr et al.

(10) Patent No.: US 6,565,798 B2
(45) Date of Patent: May 20, 2003

(54) METHOD OF RELINING A VESSEL

(75) Inventors: Matthew John Gurr, Booragoon (AU); Martin Joseph Dunne, West Midland (AU)

(73) Assignee: Technological Resources Pty. Ltd., Melbourne (AU)

( * ) Notice: Subject to any disclaimer, the term of this patent is extended or adjusted under 35 U.S.C. 154(b) by 0 days.

(21) Appl. No.: 09/768,791

(22) Filed: Jan. 25, 2001

(65) Prior Publication Data

US 2001/0020758 A1 Sep. 13, 2001

(30) Foreign Application Priority Data

Jan. 25, 2000 (AU) ..... PQ5255

(51) Int. Cl.[7] ..... F27D 1/16

(52) U.S. Cl. ..... 266/44; 266/281; 266/275; 264/30

(58) Field of Search ..... 264/30; 266/45, 266/280, 281, 275, 44

(56) References Cited

U.S. PATENT DOCUMENTS 4,848,750 A * 7/1989 Jorquera ..... 266/44
5,217,658 A * 6/1993 Schmidt et al. ..... 264/30
6,143,054 A * 11/2000 Dry ..... 75/500

* cited by examiner

*Primary Examiner*—Scott Kastler
(74) *Attorney, Agent, or Firm*—Miles & Stockbridge P.C.; John C. Kerins

(57) ABSTRACT

A method of relining a vessel that is used to carry out a direct smelting process that produces molten metal under conditions requiring molten bath temperatures of at least 1000° C. is disclosed. The vessel is of the type that has a floor that is refractory lined, a side wall that is at least partially refractory lined, and a top wall, and at least two access openings to the interior of the vessel. The relining method includes the steps of cooling down the vessel, gaining access to the interior of the vessel via the access openings, relining the vessel, and re-starting operation of the process in a period of time of 21 or less days.

26 Claims, 4 Drawing Sheets

METHOD OF RELINING A VESSEL

The present invention relates to a method of relining a refractory lined vessel which is used to carry out a molten-based direct smelting process that produces molten metal under conditions requiring molten bath temperatures of at least 1000° C.

The present invention relates particularly, although by no means exclusively, to a method of relining a refractory lined vessel which is used to carry out the HIsmelt molten bath-based direct smelting process.

The present invention also relates to a refractory lined vessel which is constructed having regard to the relining method of the present invention.

The term "direct smelting process" is understood to mean a process that produces a molten metal directly from a metalliferous feed material, such as iron ore and partly reduced iron ore.

One known group of direct smelting processes is based on the use of electric furnaces as the major source of energy for the smelting reactions.

Another known direct smelting process, which is generally referred to as the Romelt process, is based on the use of a large volume, highly agitated molten slag bath as the medium for smelting top-charged metal oxides to metal and for post-combusting gaseous reaction products and transferring the heat as required to continue smelting metal oxides.

Another known group of direct smelting processes that are slag based is generally described as "deep" slag processes. These processes, such as DIOS and AISI processes, are based on forming a deep layer of molten slag with a number of regions, including: an upper region for post-combustion reaction gases with injected oxygen; a lower region for smelting metal oxides to metal; and an intermediate region which separates the upper and lower regions.

The HIsmelt direct smelting process relies on a molten metal layer as a reaction medium and includes the steps of:

(a) forming a bath of molten metal and slag in a vessel;

(b) injecting into the bath:

(i) metalliferous feed material, typically, metal oxides; and (ii) a solid carbonaceous material, typically coal, which acts as a reductant of the metalliferous feed material and as a source of energy; and (c) smelting the metalliferous feed material to metal in the metal layer.

The HIsmelt process also includes post-combusting reaction gases, such as carbon monoxide and hydrogen, released from the bath, in the space above the bath with oxygen-containing gas and transferring the heat generated by post-combustion to the bath to contribute to the thermal energy required to smelt the metalliferous feed material.

The HIsmelt process also includes forming a transition zone above the nominal quiescent surface of the bath in which there is a favourable mass of ascending and thereafter descending droplets or splashes or streams of molten material which provide an effective medium to transfer to the bath the thermal energy generated by post-combusting reaction gases above the bath.

A preferred form of the HIsmelt process is described in International application PCT/AU99/00538 in the name of the applicant and the disclosure in this International application is incorporated herein by cross-reference.

There is a range of known vessels that has been developed to undertake the above-described and other known molten bath-based direct smelting processes.

By way of example, a vessel for carrying out the HIsmelt process is described in International application PCT/AU99/00537 in the name of the applicant. The disclosure in this International application is incorporated herein by cross-reference.

One factor that is relevant to the economics of direct smelting processes is the amount of time that is required to reline vessels that are used to carry out the processes. During this time molten metal production must cease.

In the case of the Hismelt process, the applicant expects that a partial reline would be required annually and a full reline would be required every two years. The term "partial reline" of a vessel is understood to mean a reline which replaces refractories in the side wall of the vessel and optionally some hearth repairs/upper vessel repairs to patch these sections of the vessel.

The term "full reline" of a vessel is understood to mean a reline which replaces the side wall refractories and also replaces the refractories in the vessel floor and replaces the water cooled panels in the side wall and top wall.

According to the present invention there is provided a method of relining a vessel that is used to carry out a direct smelting process that produces molten metal under conditions requiring molten bath temperatures of at least 1000° C., which vessel has a floor that is refractory lined, a side wall that is at least partially refractory lined, and a top wall, and at least two access openings to the interior of the vessel, whereby after shutting down operation of the direct smelting process, the relining method includes the steps of cooling down the vessel, gaining access to the interior of the vessel via the access openings, relining the vessel, and re-starting operation of the process in a period of time of 21 or less days.

Preferably the shutdown period is 20 or less days. More preferably the shutdown period is 18 or less days.

More preferably the shutdown period is 15 or less days.

Preferably there is at least one access opening in the vessel side wall in a hearth region of the vessel and at least one access opening in an upper section of the vessel.

More preferably, there are 2 side wall access openings in the hearth region of the vessel and at least one access opening in the upper section of the vessel.

It is preferred that the side wall access openings be diametrically opposed.

It is preferred that the side wall access openings be in the form of closable doors in the side wall.

Preferably there is a further access opening in the floor of the vessel.

Preferably the vessel includes at least one solids injection lance extending through the side wall and at least one lance for injecting oxygen-containing gas into an upper region of the vessel.

Preferably the side wall of the vessel includes water-cooled panels.

Preferably the top wall of the vessel incudes water-cooled panels.

Preferably the vessel includes a forehearth.

With the above-described construction of the vessel, preferably the step of cooling down the vessel is completed in 24 or less hours.

Preferably the cooling down step cools down the vessel by forced convection cooling or by quench cooling. Without taking such specific steps the cooling down period needed before personnel enter the vessel to commence a conventional reline can take days, with the overall reline likely to take well over a month.

In addition, with this vessel preferably the step of gaining access to the interior of the vessel via the access openings is completed within 30 or less hours in the case of a partial reline of the vessel and 54 or less hours in the case of a full vessel reline.

Typically, in both a partial reline and a full reline of the vessel this step includes isolating the vessel from sources of feed materials, removing lances/tuyeres, and opening the access openings.

Further, with this vessel preferably the step of relining the vessel is completed in 370 or less hours in the case of the partial reline of the vessel and 492 or less hours in the case of the full vessel reline.

Typically, the step of relining the vessel in the partial reline includes the steps of removing the existing refractory lining, installing a safety lining on the side wall, installing a hot face lining on the safety lining, installing a slag zone lining on the safety lining, installing lances/tuyeres, and connecting the vessel to feed materials sources.

Preferably the safety lining includes an outer permanent lining and an inner replaceable refractory brick lining, and the step of installing the safety lining includes patching the permanent lining and laying a new replaceable brick lining.

Preferably the hot face lining and the slag zone lining are formed from refractory bricks.

Typically, the step of relining the vessel in the full reline includes the above-described partial reline steps and also includes the steps of replacing water cooled panels in the side and top walls, removing and replacing the forehearth, and installing a refractory floor.

Preferably the step of replacing the water cooled panels in the top wall includes removing the top wall, replacing the water cooled panels in the top wall, and thereafter repositioning the top wall on the vessel.

Preferably the step of relining the vessel in the full reline includes bricking the forehearth connection between the forehearth and the vessel and using the brickwork of the forehearth connection that extends into the vessel as a key for the brickwork for the replaceable safety lining and the hot face lining.

Preferably the step of installing the refractory floor includes laying one or more courses of precast refractory blocks as a sub-floor and laying a top course of refractory bricks on the sub-floor.

Further with this vessel preferably the step of re-starting operation of the direct smelting process after relining is completed in 96 or less hours.

Preferably the step of relining the vessel includes positioning a safety platform above a hearth region of the vessel and thereby dividing the vessel into two work zones, one above the safety platform and the other below the safety platform, so that relining work can be carried out simultaneously in both zones.

Preferably the step of relining the vessel includes positioning on the platform an assembly that can support and raise and lower water cooled panels and using the assembly as required to remove water cooled panels from the side wall or the roof and positioning replacement water cooled panels on the side wall or the roof.

According to the present invention there is also provided a vessel for carrying out a direct smelting process, which vessel includes: a base which defines a vessel floor, a side wall, and a top wall, an off-gas duct, at least one solids injection lance/tuyere extending through the side wall, at least one lance for injecting an oxygen-containing gas into an upper region of the vessel, a refractory lining at least in a hearth region of the vessel which contains molten material during operation of the process, and at least one access opening in the side wall in the hearth region.

Preferably the vessel includes 2 access openings in the side wall in the hearth region.

Preferably the vessel includes an access opening in the vessel floor.

Preferably the floor access opening is a removable plug.

Preferably the vessel includes one or more courses of precast refractory blocks which form a sub-floor and a top course of refractory bricks laid on the sub-floor.

Preferably the top wall is removable from the vessel.

Preferably the vessel includes a forehearth for discharging molten metal from the vessel.

Preferably the forehearth can be disconnected from the vessel.

The present invention is described further by way of example with reference to the accompanying drawings of which:

Figure 1:
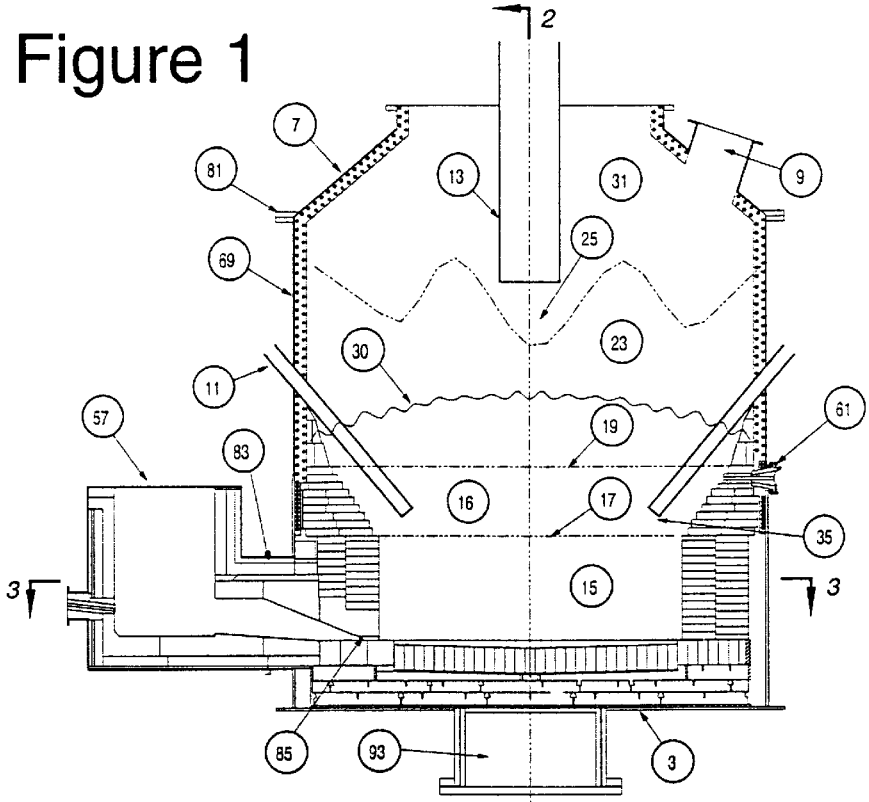
FIG. 1 is a vertical section though a vessel that is suitable for carrying out the HIsmelt process.
Figure 2:
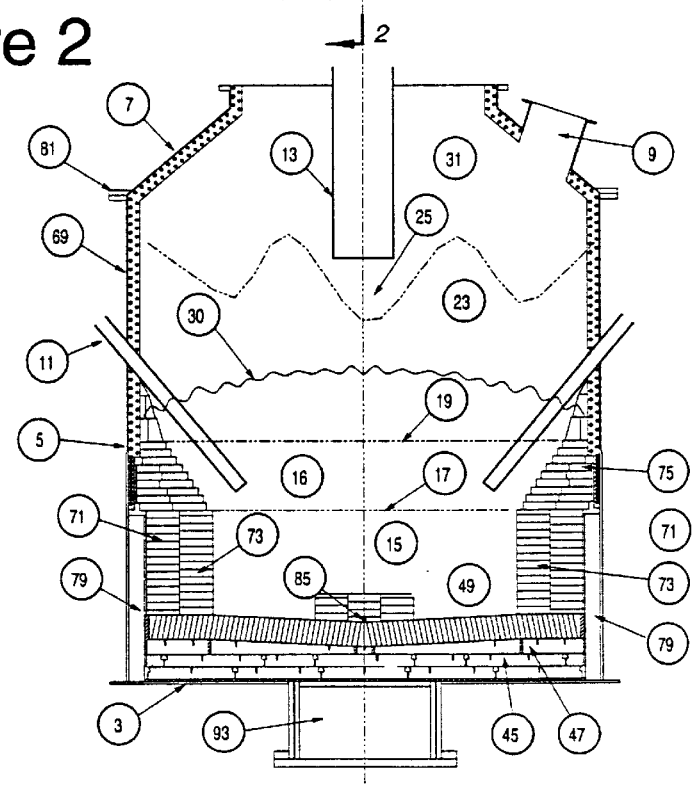
FIG. 2 is a section along the line 2—2 of FIG. 1.
Figure 3:
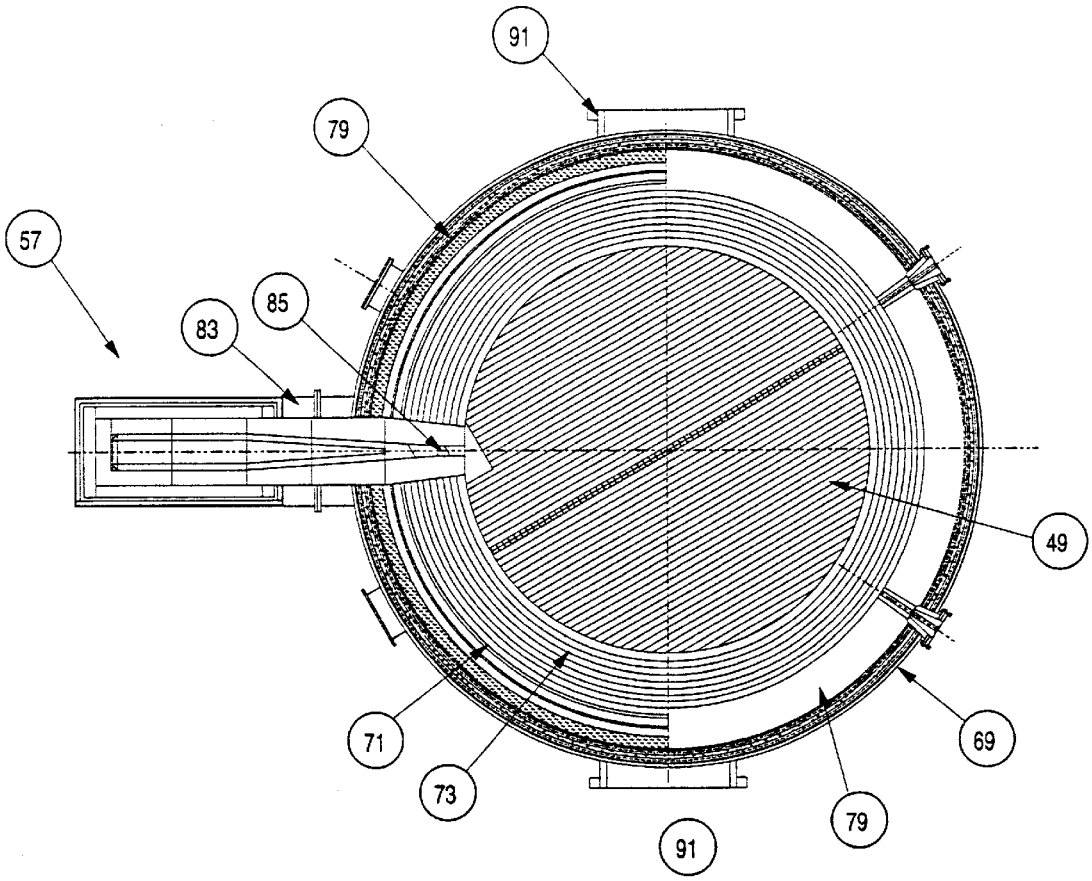
FIG. 3 is a section along the line 3—3 of FIG. 1.
Figure 5:
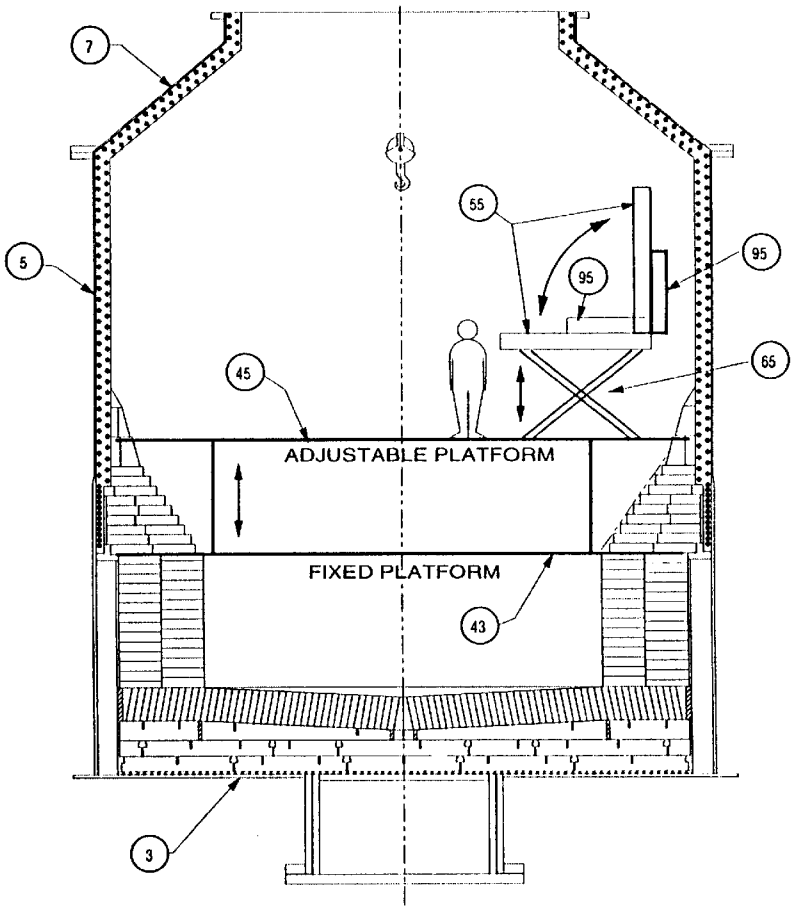
Figure 4:
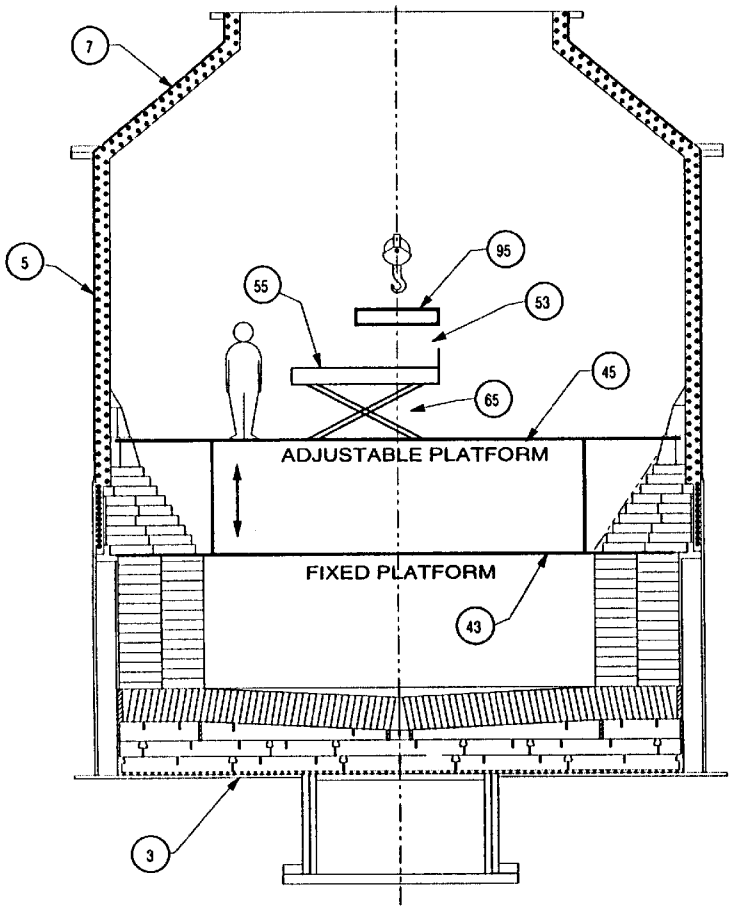
Figure 7:
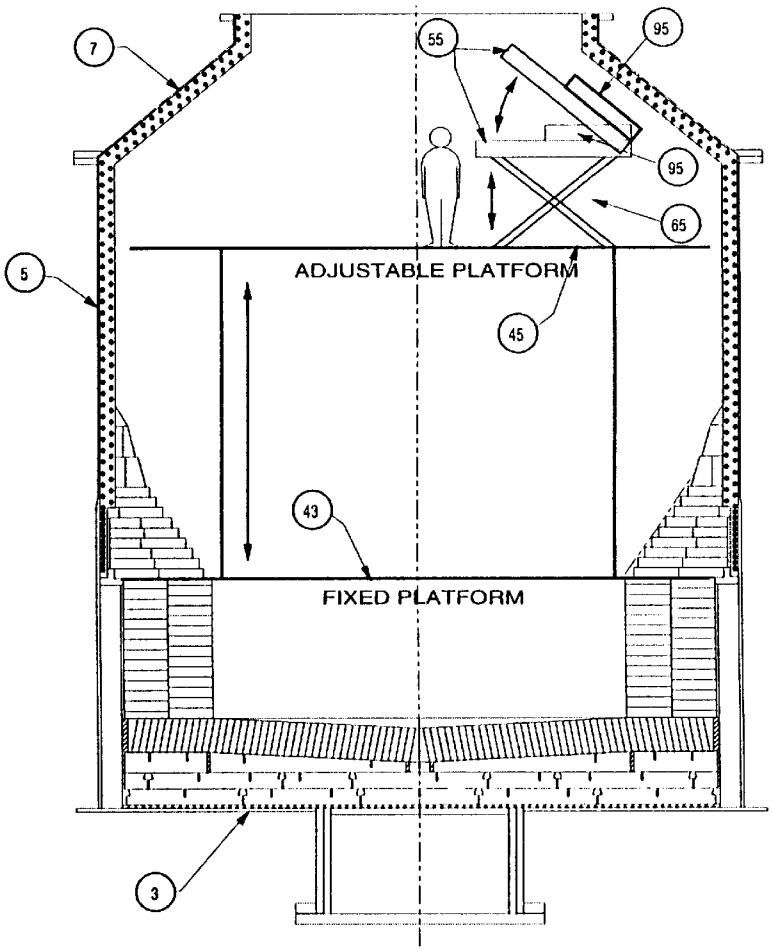
Figure 6:
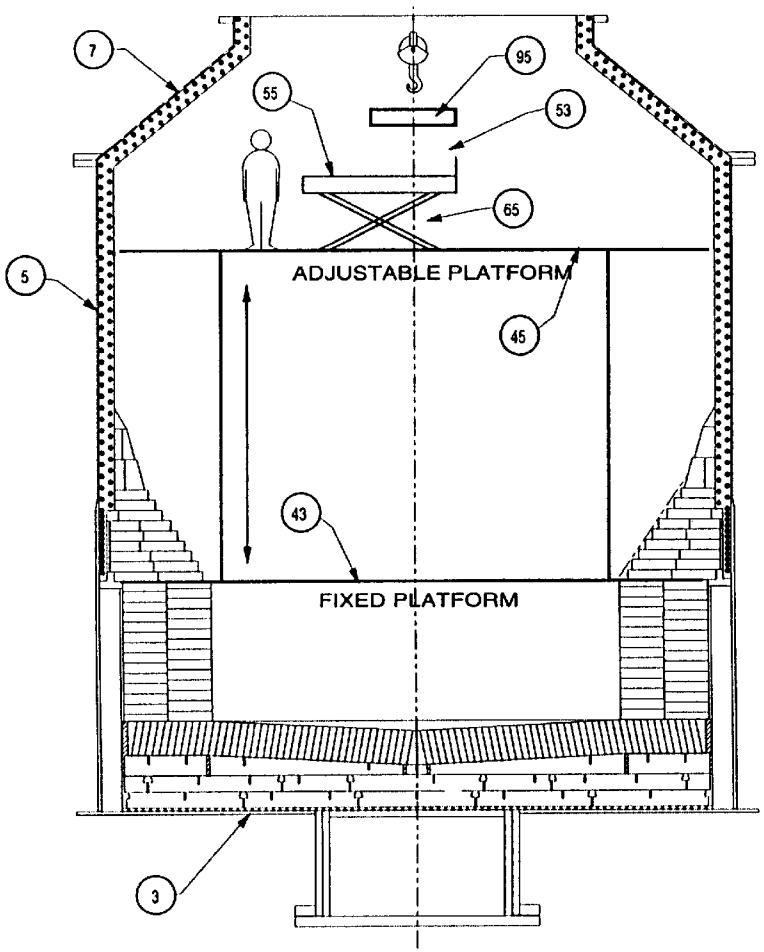

FIGS. 4 to 7 are vertical sections through the vessel shown in FIGS. 1 to 3 with the oxygen-containing gas and solids injection lances/tuyeres removed from the vessel—as would be the case during a vessel reline—which illustrate the use of a safety platform and an assembly for removing existing water cooled panels and installing replacement water cooled panels on the side wall and the roof of the vessel during the course of a vessel reline.

The vessel shown in the figures includes a base 3, a side wall 5 which forms a generally cylindrical barrel, a roof 7, a forehearth 57 for continuously discharging molten metal, a tap hole 61 for periodically discharging slag, and an off-gas duct 9.

In use of the vessel in accordance with the HIsmelt process described in International application PCT/AU99/00538, the vessel contains a molten bath which includes a layer 15 of molten metal and a layer 16 of molten slag on the metal layer 15. The arrow marked by the numeral 17 indicates the position of the quiescent surface of the metal layer 15 and the arrow marked by the numeral 19 indicates the position of the quiescent surface of the slag layer 16. The term "quiescent surface" is understood to mean the surface when there is no injection of gas and solids into the vessel.

The vessel side wall 5 includes an outer metal shell 69.

In addition, lower sections of the side wall 5 that form a hearth region that contacts and contains the layers 15,16 of molten metal and slag include a refractory lining, and upper sections of the side wall 5 above the hearth region include water cooled panels 10.

The refractory lining includes a permanent safety lining 79 cast on the metal shell 69, a replaceable safety lining 71, a hot face lining 73 on the safety lining 71 in the region that is contacted by the molten metal layer 15, and a slag zone lining 75 on the safety lining 71 in the region that is contacted by the slag layer 16.

In addition, the base 3 of the vessel includes a hearth floor that is lined with refractory material.

In addition, the top wall 7 of the vessel includes water cooled panels 10.

Typically, the replaceable safety lining 71, the hot face lining 73, and the slag zone lining 75 are formed from refractory bricks. Typically, the hearth floor includes two courses 45,47 of precast refractory blocks that form a sub-floor and a top course 49 of refractory bricks.

The vessel also includes multiple solids injection lances/tuyeres 11 (2 of which are shown) extending downwardly and inwardly at an angle of 30°–60° to the vertical through the side walls 5 and into the slag layer 16. The position of the lances/tuyeres 11 is selected so that the lower ends 35 are above the quiescent surface 17 of the metal layer 15.

In use of the HIsmelt process, metalliferous feed material (typically fines), solid carbonaceous material (typically coal), and fluxes (typically lime and magnesia) entrained in a carrier gas (typically $N_2$) are injected into the metal layer 15 via the lances/tuyeres 11. The momentum of the solid material/carrier gas causes the solid material and the carrier gas to penetrate the metal layer 15. The coal is devolatilised and thereby produces gas in the metal layer 15. Carbon partially dissolves into the metal and partially remains as solid carbon. The metalliferous feed material is smelted to metal and the smelting reaction generates carbon monoxide gas. The gases transported into the metal layer 15 and generated via devolatilisation and smelting produce significant buoyancy uplift of molten metal, solid carbon, and slag (drawn into the metal layer 15 as a consequence of solid/gas/injection) from the metal layer 15 which generates an upward movement of splashes, droplets and streams of molten metal and slag, and these splashes, droplets, and streams entrain slag as they move through the slag layer 16.

The buoyancy uplift of molten metal, solid carbon and slag causes substantial agitation in the metal layer 15 and the slag layer 16, with the result that the slag layer 16 expands in volume and has a surface indicated by the arrow 30. The extent of agitation is such that there is reasonably uniform temperature in the metal and the slag regions—typically, 1450–1550° C. with a temperature variation of the order of 30° C.

In addition, the upward movement of splashes, droplets and streams of molten metal and slag—caused by the buoyancy uplift of molten metal, solid carbon, and slag—extends into the space 31 (the "top space") above the molten material in the vessel and forms a transition zone 23.

The vessel further includes a lance 13 for injecting an oxygen-containing gas (typically pre-heated oxygen enriched air) which is centrally located and extends vertically downwardly into the vessel. The position of the lance 13 and the gas flow rate through the lance 13 are selected so that the oxygen-containing gas penetrates the central region of the transition zone 23 and maintains an essentially metal/slag free space 25 around the end of the lance 13.

The injection of the oxygen-containing gas via the lance 13 in accordance with the HIsmelt process post-combusts reaction gases CO and $H_2$ in the transition zone 23 and in the free space 25 around the end of the lance 13 and generates high temperatures of the order of 2000° C. or higher in the gas space. The heat is transferred to the ascending and descending splashes, droplets, and streams of molten material in the region of gas injection and the heat is then partially transferred to the metal layer 15 when the metal/slag returns to the metal layer 15.

As indicated above, it is important to the economics of the HIsmelt process to be able to carry out required periodic relines of the vessel in a time period that is as short as possible. This is particularly so where the vessel is the sole supplier of hot metal to the downstream refining and manufacturing operations, for example where the HIsmelt process is providing molten iron to a mini steel mill having EAF and casting machines. Minimising vessel reline time is a difficult objective given the substantial amount of material that has to be removed from the vessel and placed in the vessel. By way of example, for a 6 m diameter vessel there would be 500–600 tonnes of refractory material alone.

The applicant has established a reline schedule for the vessel when the vessel is used for the HIsmelt process which includes a partial reline each year and a full reline every two years. In the context of the vessel as shown in the figure:

(a) a partial reline involves patching the permanent safety lining 79 and replacing (by re-bricking) each of the replaceable safety lining 71, the hot face lining 73 and the slag zone lining 75; and (b) a full reline involves patching and replacing the linings referred to in (a) above and also involves replacing each of (i) the course 45, 47, 49 of refractory bricks that form the hearth floor, (ii) the forehearth 57, and (iii) the water cooled panels in the side and top walls 5,7.

In order to reline the vessel with minimal shutdown time, the vessel includes 2 diametrically opposed doors 91 in the side wall 5 (shown in FIG. 3) and a plug 93 in the base 3, and these doors 91 and plug 93 define access openings to the interior of the vessel after the HIsmelt process operating in the vessel has been shut down.

Typically, the side access openings are sufficiently large, eg 2×2 m, to allow access of refractory wrecking equipment, such as KT-30 remote wrecking device manufactured by Keibler Thompson, into the interior of the vessel via the openings. Alternatively the refractory wrecking equipment can be supported at the top of the vessel and commence wrecking from the top of the vessel.

Typically, the bottom plug 93 is sufficiently large, eg 3 m diameter, to allow convenient removal of at least a substantial part of the spent refractory lining.

Furthermore, the vessel is constructed with a flanged connection 81 between the lower edge of the top wall 7 and the upper edge of the side wall 5 so that the top wall 7 can be removed altogether in a full reline of the vessel. This allows access to the interior of the vessel during a shutdown. In addition, it makes it possible for the water cooled panels of the top wall 7 to be replaced more conveniently than if the top wall is in situ on the vessel. In addition, removal of the top wall 7 makes it possible for the relining work to continue in the vessel at the same time as the water cooled panels of the top wall are being replaced. In a partial vessel reline, during which it is not necessary to replace water cooled panels, removal of the top wall is not necessary and top access to the vessel is achieved by removing the oxygen injection lance 13 and accessing the vessel via the resultant opening in the vessel.

Furthermore, the vessel is constructed with a flanged connection 83 between the forehearth 57 and the side wall 5 so that the forehearth 57 can be disconnected from the side wall 5 during a reline and replaced with another forehearth that has a required refractory lining. This feature speeds up the reline method.

Moreover, in accordance with a preferred embodiment of the reline method, the new forehearth is positioned, the forehearth connection 85 between the forehearth 57 and the interior of the vessel is bricked from the forehearth 57 into the vessel interior prior to commencement of or at least at an early stage of bricking the replaceable safety lining 71. As a consequence, the brickwork of the forehearth connection 85 that extends into the vessel interior provides a key for this and the other side wall brickwork. This step significantly speeds up the side wall brickwork process.

In general terms the relining method includes the steps of cooling down the vessel, gaining access to the interior of the vessel via the access openings, relining the vessel, and re-starting operation of the HIsmelt process. Each of these general steps includes a number of steps. By way of example, the general step of relining the vessel includes steps such as wrecking and removing the spent refractory brick lining on the side walls in the case of a partial reline and rebricking the side wall, and re-installing the lances/tuyeres 11,13.

A summary of the steps and the time periods for the steps in one embodiment of the reline method of the present invention for making a partial reline of the vessel in a total shutdown time of 11.75 days is set out in Table 1 below.

TABLE 1

(Partial Reline)

| Task Partial Reline (Annual) | Duration (Days) 11.75 | Comments |
|---|---|---|
| | Duration (Hours) | |
| Wind Assisted Cooldown | 24 | |
| Isolate Vessel | 6 | |
| Remove HAB Lance 13 | 6 | Removal of the HAB lance 13, sold injection lances and side openings can be carried out at the same time |
| Remove Solid Injection Lances 11 | 6 | |
| Open Side openings 91 | 6 | Can be commenced after end tap |
| Measure Refractory lining | 6 | Requires use of a laser device or similar |
| Refractory Wrecking | 24 | Utilise remote wrecking equipment through side opening 91. Spent lining removed through opposite door |
| Install Safety Deck | 6 | Required to allow working on panels while slag zone is being relined. |
| Install Modular Refractory Forehearth | 24 | The modular forehearth is only the internal vessel portion. External forehearth is reline every alternate year. |
| Safety Lining 71 | 30 | |
| Hot Face Lining 73 | 24 | |
| Slag Zone 75 | 18 | |
| Close side openings | 6 | Side openings closed up. Access via charge hole. |
| Clean panels | 24 | Carried out at same time as slag zone reline |
| Gun Water Cooled Panels | 48 | |
| Remove Safety Deck | 6 | |
| Install Lances 11 | 6 | Once lances are installed require to gun around lances to protect. |
| Gun around lances 11 | 6 | |
| Install HAB Lance 13 | 12 | |
| Box Up | 12 | |
| De-isolate Vessel | 6 | |

For the most part the above-described tasks do not require any explanation.

One exception is the first task "Wind Assisted Cooldown". In the case of the partial reline, cooldown by forced convection via the oxygen-containing gas injection lance 13 is required to cool down the interior of the vessel quickly, at least to 800° C. to allow remote controlled wrecking equipment to operate in the vessel. In the case of a full reline, convection cooling is also an option. Another option is quench cooling with water.

In the above embodiment it is not necessary to remove the bottom plug 93 because the 2 side doors 91 and the top opening can handle the amount of material that is removed from the vessel and is supplied to the vessel to reline the vessel.

A summary of the steps and the time periods for the steps in one embodiment of the reline method of the present invention for making a full reline of the vessel in a total shutdown time of 20.24 days is set out in Table 2.

TABLE 2

(Full Reline)

| Task Full Reline (Alternate Year) | Duration (Days) 20.24 | Comments |
|---|---|---|
| | Duration (Hours) | |
| Wind Assisted Cooldown | 24 | |
| Isolate Vessel | 6 | |
| Remove HAB Lance 13 | 6 | Removal of the HAB lance 13, sold injection lances 11 and side openings 91 can be carried out at the same time |
| Measure Refractory lining | 6 | |
| Remove top of Vessel | 24 | Top of vessel flanged. Removed after internal refractory measured |
| Remove Solid Injection Lances 11 | 6 | |
| Open Side openings 91 | 6 | Can be commenced after end tap |
| Refractory Wrecking | 96 | Wrecking of vessel can commence during removal of top Materials require to be removed through side openings |
| Remove Panel Fixing | 96 | |
| Remove Panels | 24 | Pushed in and dropped to the bottom of furnace. |
| Install Levelling layer | 24 | Foundation for refractory lining. |
| Precast Floor Safety Course | 8 | Overhead crane required to assist in installation of blocks |
| Precast Floor Safety 2 Course | 8 | |
| Precast Subfloor | 8 | |
| Install Hearth Floor | 36 | Safety deck lowered in from top |
| Install Safety Deck | 6 | |
| Install Modular Refractory Forehearth | 24 | Total forehearth rebuild. |
| Safety Lining 71 | 30 | |
| Hot Face Lining 73 | 24 | |
| Slag Zone 75 | 18 | |
| Remove and install Roof Panels Off-site | 144 | Worked carried out off-site |
| Install Panels | 96 | Panels and welding of barrel panels carried out with slight lag |
| Fix Panels and Reconnect Circuit | 72 | |
| Close side openings | 6 | |
| Remove Safety Deck | 6 | Though top of vessel |
| Reinstall Roof | 24 | |
| Install Lances 11 | 12 | |
| Gun around lances 11 | 12 | Access through charge hole |
| Install HAB Lance 13 | 6 | |
| Box up | 6 | |
| De-isolate Vessel | 6 | |
| Heat Up | 96 | |
| Heat Up | 96 | 4 day heat-up is relatively quick. Based on 50 C per hour plus soak period. |

In this embodiment, as with the partial reline embodiment summarised in Table 1, the bottom plug 93 is not removed from the vessel. Accordingly, spent refractory lining and side wall cooling panels are removed via the side doors 91. This embodiment includes removing the top wall 7 of the vessel.

A summary of the steps and the time periods for the steps in another embodiment of the reline method of the present invention for making a full reline of the vessel in a total shutdown time of 18.24 days, is set out in Table 3.

TABLE 3

| Task | Duration (Days) | Comments |
|---|---|---|
| Full Reline (Alternate Year) | 18.24 | |
| | Duration (Hours) | |
| Wind Assisted Cooldown | 24 | |
| Isolate Vessel | 6 | |
| Remove HAB Lance 13 | 6 | Removal of the HAB Lance 13, sold injection lances 11 and side openings 91 can be carried out at the same time |
| Measure Refractory lining | 6 | |
| Remove top of Vessel | 24 | Top of vessel flanged. Removed after internal refractory Measured |
| Remove Solid Injection Lances 11 | 6 | |
| Open Side openings 91 | 6 | |
| Refractory Wrecking | 24 | Refractory is pushed out through bottom of furnace |
| Remove panel fixing | 72 | |
| Remove Panels | 48 | Pushed in and dropped to the bottom of furnace. |
| Install Levelling Course | 24 | |
| Precast Safety Course | 8 | |
| Precast Safety 2 Course | 8 | |
| Precast Subfloor | 8 | Overhead crane required to assist in installation of blocks |
| Install Hearth Floor | 36 | Safety deck lowered in from top |
| Install Safety Deck | 6 | |
| Install Modular Refractory Forehearth (Total) | 24 | Total forehearth rebuild. |
| Safety Lining 71 | 30 | |
| Hot Face Lining 73 | 24 | |
| Slag Zone 75 | 18 | |
| Install Panels | 96 | Worked carried out off-site |
| Fix Panels And reconnect Circuit | 72 | Panels and welding of barrel panels carried out with slight lag |
| Close side openings | 6 | |
| Remove Safety Deck | 6 | |
| Remove and install Roof Panels Offsite | 144 | Replacement of panels carried out offsite |
| Reinstall Roof | 24 | |
| Install Lances 11 | 12 | |
| Gun around lances 11 | 6 | |
| Install HAB Lance 13 | 6 | |
| Box up | 6 | |
| De-isolate Vessel | 6 | |
| Heat Up | 96 | |

In this embodiment the bottom plug 93 is removed to speed up removal of spent refractory material from the vessel.

Each of the above embodiments includes the steps of installing a safety deck to allow work to be undertaken simultaneously on:

(a) the hearth region; and (b) upper sections of the side wall 5 (i.e. the region of the slag zone lining 75 and the water cooled panels above this lining) and the top wall 7.

FIGS. 4 to 7 illustrate a preferred embodiment of a safety deck and an assembly for removing existing water cooled panels and for installing replacement water cooled panels on the side wall 5 and the roof 7.

It is noted that the reline method that is illustrated in FIGS. 4 to 7 is different to the above described full relines in that the FIGS. 4 to 7 method does not include the step of removing the top wall 7.

The safety deck includes a fixed platform 43 that is positioned to extend across the vessel at an upper level of the hearth region. Essentially, the platform 43 divides the vessel into two zones, one above and the other below the platform 42. As a consequence, it is possible to carry out relining work simultaneously (and safely) in both zones.

The safety deck also includes an adjustable platform 45 that is mounted to the fixed platform 43 and can be raised and lowered in relation to the fixed platform 43, as shown in FIGS. 4 to 7. The adjustable platform 45 may be mounted to the fixed platform 43 and moveable in relation to the fixed platform 43 by any suitable means.

The adjustable platform 45 defines a work surface for persons and equipment involved in relining the upper section of the side wall 5 above the hearth region and the top wall 7.

The water cooled panel support assembly, generally identified by the numeral 53, includes a tiltable support platform 55 mounted on adjustable scissor legs 65. As is illustrated in FIGS. 4 to 7:

(a) the support platform 55 can be positioning horizontally and can receive and support a replacement water cooled panel 95 that is lowered into the vessel through the HAB opening in the vessel;

(b) the adjustable platform 45 can be raised (or lowered) to a required level; and (c) the support platform 55 can be raised and lowered via the operation of the scissor legs 65 and tilted as required to position the replacement water cooled panel 95 in a nominated position in the side wall 5 or the top wall 7.

Similarly, the assembly 53 may be operated to remove an existing water cooled panel 10 from its position in the side wall 5 or the top wall 7.

Many modifications may be made to the preferred embodiments of the present invention described without departing from the spirit and scope of the invention.

By way of example, whilst the preferred embodiments include a plug 93 in the base 3 of the vessel, the present invention is not limited to such an arrangement and extends to arrangements that do not include the plug 93.

By way of further example, while the preferred embodiments include a flanged connection 81 between the lower edge of the top wall 7 and the upper edge of the side wall 5 so that the top wall 7 can be removed, the present invention is not limited to such an arrangement.

What is claimed is:

1. A method of relining a vessel that is used to carry out a direct smelting process that produces molten metal under conditions requiring molten bath temperatures of at least 1000° C., which vessel has a floor that is refractory lined, a side wall that is at least partially refractory lined and includes water cooled panels, a top wall, at least two access openings to the interior of the vessel, with at least one access opening in the side wall in a hearth region of the vessel and at least one access opening in an upper section of the vessel, and at least one lance for injecting oxygen-containing gas into an upper region of the vessel, whereby after shutting down operation of the direct smelting process, the relining method includes the steps of:

(a) cooling down the vessel;

(b) gaining access to the interior of the vessel via the access openings by isolating the vessel from sources of feed materials, removing said at least one lance, and opening the access openings;

(c) relining the vessel; and (d) re-starting operation of the process in a period of time of 21 or less days.

2. The method defined in claim 1 wherein the shutdown period is 18 or less days.

3. The method defined in claim 2 where the shutdown period is 15 or less days.

4. The method defined in claim 1 wherein there are 2 side wall access openings in the hearth region of the vessel and at least one access opening in an upper section of the vessel.

5. The method defined in claim 4 wherein there is a further access opening in the floor of the vessel.

6. The method defined in claim 1 wherein the vessel includes at least one solids injection lance extending through the side wall of the vessel.

7. The method defined in claim 1 wherein the top wall of the vessel includes water-cooled panels.

8. The method defined in claim 1 wherein the vessel includes a forehearth.

9. The method defined in claim 1 where the step of cooling down the vessel is completed in 24 or less hours.

10. The method defined in claim 1 wherein the step of cooling down the vessel includes forced convection cooling or quench cooling.

11. The method defined in claim 1 wherein the step of gaining access to the interior of the vessel via the access openings is completed within 30 or less hours in the case of a partial reline of the vessel and within 54 or less hours in the case of a full vessel reline.

12. The method defined in claim 1 wherein the step of relining the vessel is completed in 370 or less hours in the case of a partial reline of the vessel and 492 or less hours in the case of a full vessel reline.

13. The method defined in claim 1 wherein the step of relining the vessel in a partial reline includes the steps of removing the existing refractory lining, installing a safety lining on the side wall, installing a hot face lining on the safety lining, installing a slag zone lining on the safety lining, installing lances/tuyeres, and connecting the vessel to feed materials sources.

14. The method defined in claim 13 wherein the safety lining includes an outer permanent lining and an inner replaceable refractory brick lining and the step of installing the safety lining includes patching the permanent lining and laying a new replaceable brick lining.

15. The method defined in claim 13 wherein the step of relining the vessel in a full reline includes the partial reline steps and also includes the steps of replacing water cooled panels in the side and top walls, removing and replacing the forehearth, and installing a refractory floor.

16. The method defined in claim 15 wherein the step of replacing the water cooled panels in the top wall includes removing the top wall, replacing the water cooled panels in the top wall, and thereafter repositioning the top wall on the vessel.

17. The method defined in claim 15 wherein the step of relining the vessel in the full reline includes bricking a forehearth connection between the forehearth and the vessel and using the brickwork of the forehearth connection that extends into the vessel as a key for the brickwork for the replaceable safety lining and the hot face lining.

18. The method defined in claim 15 wherein the step of installing the refractory floor includes laying one or more courses of precast refractory blocks as a sub-floor and laying a top course of refractory bricks on the sub-floor.

19. The method defined in claim 1 wherein the step of re-starting operation of the direct smelting process after relining is completed in 96 or less hours.

20. The method defined in claim 1 wherein the step-of relining the vessel includes positioning a safety platform above a hearth region of the vessel and thereby dividing the vessel into two work zones, one above the safety platform and the other below the safety platform, so that relining work can be carried out simultaneously in both zones.

21. The method defined in claim 20 wherein the step of relining the vessel includes positioning on the platform an assembly that can support and raise and lower water cooled panels and using the assembly as required to remove water cooled panels from the side wall or the roof and positioning replacement water cooled panels on the side wall or the roof.

22. A vessel for carrying out a direct smelting process, which vessel includes: a base which defines a vessel floor, a side wall, and a top wall, an off-gas duct, at least one solids injection lance/tuyere extending through the side wall, at least one lance for injecting an oxygen-containing gas into an upper region of the vessel, a refractory lining at least in a hearth region of the vessel which contains molten material during operation of the process, a plurality of access openings, at least two of which are diametrically opposed to each other in the side wall in the hearth region, and an access opening in the vessel floor.

23. The vessel defined in claim 22 wherein the floor access opening is a removeable plug.

24. The vessel defined in claim 22 further including one or more courses of precast refractory blocks which form a sub-floor and a top course of refractory bricks laid on the sub-floor.

25. The vessel defined in claim 22 further including a forehearth for discharging molten metal from the vessel.

26. A vessel for carrying out a direct smelting process, which vessel includes: a base which defines a vessel floor, a side wall, and a top wall, an off-gas duct, at least one solids injection lance/tuyere extending through the side wall, at least one lance for injecting an oxygen-containing gas into an upper region of the vessel, a refractory lining at least in a hearth region of the vessel which contains molten material during operation of the process, and a plurality of access openings, at least two of which are diametrically opposed to each other in the side wall in the hearth region, and wherein said at least two access openings are at least about 2 m by 2 m in size.

* * * * *